US007954280B2

(12) United States Patent
Andras

(10) Patent No.: US 7,954,280 B2
(45) Date of Patent: Jun. 7, 2011

(54) BASEMENT DRAINAGE CONDUIT

(75) Inventor: Stephen Andras, Westport, MA (US)

(73) Assignee: DNI Realty, LLC, Westport, MA (US)

( * ) Notice: Subject to any disclaimer, the term of this patent is extended or adjusted under 35 U.S.C. 154(b) by 0 days.

(21) Appl. No.: 11/471,867

(22) Filed: Jun. 21, 2006

(65) Prior Publication Data

US 2007/0294966 A1 Dec. 27, 2007

(51) Int. Cl.
*E02D 31/02* (2006.01)

(52) U.S. Cl. ..... 52/169.5

(58) Field of Classification Search ..... 52/169.5, 52/302.3, 302.4, 732.2, 731.3, 843–845; 404/2, 4, 5, 26; 138/115–117; 174/17 R, 174/377, 50, 95, 387, 559, 560, 561, 563; 405/36, 43, 44, 45, 50

See application file for complete search history.

(56) References Cited

U.S. PATENT DOCUMENTS

| | | | | |
|---|---|---|---|---|
| 608,861 | A * | 8/1898 | Horton | 52/844 |
| 1,681,394 | A | 8/1928 | Carlson | |
| 1,771,770 | A | 7/1930 | Bruno | |
| 2,833,138 | A | 5/1958 | Kohn | |
| 2,941,635 | A | 6/1960 | Harris | |
| 3,283,460 | A | 11/1966 | Patrick | |
| 3,304,672 | A | 2/1967 | Bakke | |
| 3,344,569 | A | 10/1967 | Cotten | |
| 3,530,627 | A * | 9/1970 | Carter et al. | 52/220.5 |
| 3,713,539 | A | 1/1973 | Thompson et al. | |
| 3,761,603 | A * | 9/1973 | Hays et al. | 174/101 |
| 4,185,429 | A * | 1/1980 | Mendola | 52/274 |
| 4,245,443 | A | 1/1981 | Beechen | |
| 4,265,064 | A | 5/1981 | Parezo | |
| 4,333,281 | A | 6/1982 | Scarfone | |
| 4,497,260 | A * | 2/1985 | Bucher | 108/56.1 |
| 4,650,367 | A * | 3/1987 | Dietzler | 405/43 |
| 4,660,333 | A | 4/1987 | Romer | |
| 4,745,716 | A | 5/1988 | Kuypers | |

(Continued)

FOREIGN PATENT DOCUMENTS

GB 2115885 9/1983

(Continued)

OTHER PUBLICATIONS http://www.basementsystems.com/content/47/669/673/default.aspx (accessed Mar. 15, 2006).

(Continued)

*Primary Examiner* — Sunil Singh
(74) *Attorney, Agent, or Firm* — Lando & Anastasi, LLP

(57) ABSTRACT

A basement drainage conduit for use in basement waterproofing systems. The conduit has one or two side elements with apertures to admit groundwater. The conduit may further include an intermediate element to provide additional support to the conduit structure. In embodiments where the intermediate element does not define apertures, a two-channel system may result to prevent cross-flow within the conduit. The conduit may be a modular assembly, the individual components of which may be separately manufactured for on-site installation and customization. Structural features of the conduit components, such as those defining a mating system, may facilitate assembly of the conduit. Radius elements may be provided to accommodate corners to result in a continuous drainage conduit along the perimeter of a basement, and ports may be strategically positioned to allow access to the conduit interior, such as for cleaning.

22 Claims, 6 Drawing Sheets

U.S. PATENT DOCUMENTS

| | | | | |
|---|---|---|---|---|
| 4,837,991 | A | 6/1989 | Shaw | |
| 4,845,910 | A | 7/1989 | Hanson et al. | |
| 4,869,032 | A | 9/1989 | Geske | |
| 4,943,185 | A | 7/1990 | McGuckin et al. | |
| 4,983,069 | A | 1/1991 | Florence | |
| 5,199,232 | A | 4/1993 | Chandler et al. | |
| 5,367,842 | A | 11/1994 | Janesky | |
| D354,821 | S | 1/1995 | Janesky | |
| 5,501,044 | A | 3/1996 | Janesky | |
| 5,529,436 | A | 6/1996 | Meyers | |
| 5,630,299 | A | 5/1997 | Jackman et al. | |
| 5,662,048 | A * | 9/1997 | Kralj et al. | 108/56.3 |
| 5,694,723 | A | 12/1997 | Parker | |
| 5,727,901 | A | 3/1998 | Rennie et al. | |
| 5,765,323 | A | 6/1998 | Bevilacqua | |
| 5,771,643 | A | 6/1998 | Parker | |
| 5,784,838 | A | 7/1998 | Phillips | |
| 5,794,388 | A | 8/1998 | Jackman | |
| 6,027,283 | A | 2/2000 | Schweinberg et al. | |
| 6,170,095 | B1 | 1/2001 | Zars | |
| 6,230,468 | B1 | 5/2001 | Klaus | |
| D443,367 | S | 6/2001 | Janesky | |
| 6,308,924 | B1 | 10/2001 | Janesky | |
| 6,419,421 | B1 | 7/2002 | Whitfield, Jr. | |
| 6,550,190 | B2 | 4/2003 | Ruiz et al. | |
| 6,598,360 | B1 | 7/2003 | Pratt | |
| 6,601,607 | B1 | 8/2003 | Pratt | |
| 6,619,001 | B1 * | 9/2003 | Pratt | 52/169.5 |
| 6,647,682 | B2 | 11/2003 | Bishop | |
| 6,672,016 | B2 | 1/2004 | Janesky | |
| 6,719,004 | B2 | 4/2004 | Huber et al. | |
| 6,848,468 | B1 | 2/2005 | Hsien | |
| 6,904,723 | B1 | 6/2005 | Moore et al. | |
| 7,303,357 | B2 | 12/2007 | Villarreal et al. | |
| 7,437,855 | B2 | 10/2008 | Locke et al. | |
| 2002/0152696 | A1 * | 10/2002 | Ruiz et al. | 52/169.5 |
| 2003/0115814 | A1 | 6/2003 | Nielsen | |
| 2005/0198916 | A1 | 9/2005 | Janesky | |
| 2006/0032158 | A1 | 2/2006 | Moule | |
| 2006/0112653 | A1 | 6/2006 | Hogenson | |
| 2007/0044396 | A1 | 3/2007 | Janesky | |
| 2007/0068093 | A1 | 3/2007 | Grange et al. | |
| 2007/0094952 | A1 | 5/2007 | Niemczyk | |
| 2007/0175113 | A1 | 8/2007 | Moule | |
| 2007/0294965 | A1 | 12/2007 | Andras | |
| 2008/0078142 | A1 | 4/2008 | Andras | |
| 2008/0104910 | A1 | 5/2008 | Andras et al. | |

FOREIGN PATENT DOCUMENTS

| | | |
|---|---|---|
| GB | 2155076 | 9/1983 |
| JP | 02132258 | 5/1990 |

OTHER PUBLICATIONS http://www.basementsystems.com/images/WaterGuard__In__Progress.jpg (accessed Mar. 15, 2006).
http://www.basementsystems.com/content/47/71/default.aspx (accessed Mar. 15, 2006).
http://www.basementtechnologies.com/products/wraqua.html (accessed Mar. 15, 2006).
http://www.fasteel.com/WaterProofing.htm (accessed Mar. 8, 2006).

* cited by examiner

BASEMENT DRAINAGE CONDUIT

BACKGROUND OF THE INVENTION

1. Field of the Invention

At least one embodiment of the present invention relates generally to devices and methods for basement waterproofing and, more particularly, to drainage conduits for use in basement waterproofing systems.

2. Discussion of Related Art

The potential for moisture in the basement of buildings is of ongoing concern to homeowners, building contractors, and structural engineers. Basement foundation footings are typically located several feet below ground level, and water may accumulate around the foundation as the groundwater level periodically rises, for example, due to rain or melting snow. As a result, hydrostatic pressure may build causing leakage at cracks in the footings, structural interfaces, and through the floor. Concrete, typically used in the construction of foundations, attracts groundwater by sorption, and capillary forces in the concrete pores facilitate further penetration of the groundwater. Seepage of groundwater into a basement can cause significant structural damage, as well as promote the growth of harmful bacteria, such as iron bacteria. Furthermore, dangerous radon gas, and water vapors contributing to a high basement humidity level, can flow easily through the concrete pores.

Interior, sub-floor drainage systems, installed along the perimeter of a basement, have been used to address problems with moisture in basements. Such systems typically include a drainage conduit, positioned below the basement floor and in close proximity to the foundation wall, along the interior perimeter of the basement, in order to collect and convey groundwater to a sump for extraction. The conduits are generally rectangular in cross-section and may contain a plurality of apertures along one or both longitudinal sides to allow groundwater to pass into the conduit. Traditional drainage conduits are molded or extruded as unitary pieces in lengths which may require several such pieces to be joined together, typically with an adhesive or tape, in order to form a continuous conduit around the basement perimeter.

BRIEF SUMMARY OF THE INVENTION

In accordance with one or more embodiments, the invention relates generally to an improved drainage conduit for use in basement waterproofing systems.

In accordance with one or more embodiments, the invention relates to a basement drainage conduit comprising a first horizontal element and a second horizontal element, a first side element and a second side element, each extending between the first horizontal element and the second horizontal element to define a space for conveying groundwater, and an intermediate element extending between the first horizontal element and the second horizontal element along a length of the space. At least one of the first side element and the second side element defines a plurality of apertures along its length.

The first side element and the second side element may both define a plurality of apertures. In some embodiments, the conduit of the present invention may be modular. A first side of the first horizontal element and a first side of the second horizontal element may each include a plurality of mating features. The intermediate element, the first side element, and the second side element have longitudinal edges that may include a complimentary mating feature configured to mate with the mating features of the first horizontal element and the second horizontal element.

In accordance with one or more embodiments, the invention relates to a drainage conduit kit, comprising a source of a horizontal element having a first side comprising a plurality of mating features, and a source of a side element defining a plurality of apertures along its length, and having longitudinal edges comprising complimentary mating features configured to mate with the horizontal element mating features.

The drainage conduit kit may further include a source of an intermediate element having longitudinal edges comprising complimentary mating features configured to mate with the horizontal element mating features. The kit may further include one or more connector elements. The kit may still further include one or more conduit ports. The kit may further include one or more radius elements configured to receive the intermediate element and the side elements around a corner of a basement perimeter.

In accordance with one or more embodiments, the invention relates to an adjustable conduit port, comprising a base, a top configured to connect with the base to define a space for conveying groundwater, and a slider configured to be adjustably received within the top such that a vertical height of the conduit port may be adjusted relative to a basement floor level.

The base and the top may also include a plurality of mating features within the space, configured to receive complimentary mating features. The conduit port may further include a first side element within the space, having longitudinal edges that include complimentary mating features. The conduit port may still further include a second side element within the space, having longitudinal edges that include complimentary mating features. The conduit port may further include an intermediate element within the space, having longitudinal edges that include complimentary mating features. The slider may include a lid, and the lid may comprise a removable plug. The conduit port may further include an outlet fluidly connectable to a sump.

In accordance with one or more embodiments, the invention relates to a method of assembling a basement drainage system, comprising providing a length of a first horizontal element, and a length of a second horizontal element, each having a first side that includes a plurality of mating features, providing a length of a first side element, and a length of a second side element, each having longitudinal edges that include complimentary mating features, and joining each of the first side element and the second side element between the first horizontal element and the second horizontal element by engaging the mating features with the complimentary mating features to define a space for conveying groundwater in an interior portion of a basement.

At least one of the first side element and the second side element may define a plurality of apertures along its length. The method may further include providing a length of an intermediate element, and joining the intermediate element between the first horizontal element and the second horizontal element within the space. The method may still further include positioning a radius element along the drainage conduit at a corner of the basement. The method may further include incorporating a conduit port along a length of the drainage conduit. The method may further include fluidly connecting the drainage conduit to a sump.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
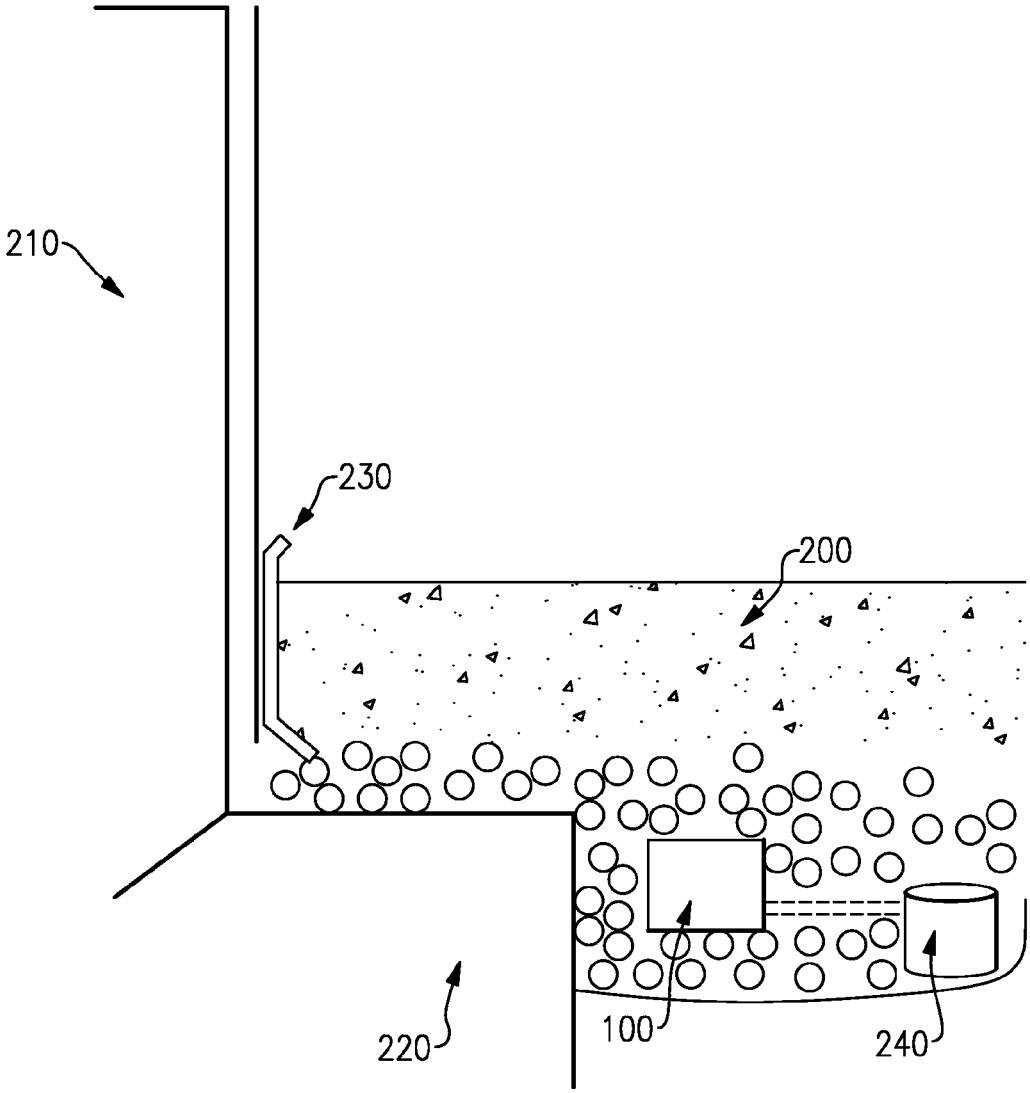
FIG. 1 illustrates a drainage conduit installed as part of a basement waterproofing system in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to an improved drainage conduit for use in sub-floor basement waterproofing systems. The drainage conduit may be effective in collecting and carrying groundwater to a remote location for extraction in order to prevent the groundwater from penetrating the basement structure. The conduit may be installed, for example, pitched, so as to promote the flow of groundwater towards a fluidly connected sump. The conduit may be installed in various foundation configurations, typically around the perimeter of a basement in close proximity to the foundation wall.

For example, FIG. 1 illustrates a conduit 100 in accordance with one or more embodiments of the present invention, positioned below a basement floor 200 relative to a foundation wall 210 and a footing 220. While the conduit 100 is exemplarily positioned adjacent to the footing 200, it should be noted that the conduit 100 may be positioned elsewhere, such as above the footing 200 adjacent to the foundation wall 210. The conduit 100 may be installed as part of a basement waterproofing system which may, for example, include a flange 230 to aid in directing water to the conduit 100. In one embodiment, the flange 230 may be implemented using a flange as described in copending U.S. patent application Ser. No. 11/471,800 to which is hereby incorporated herein by reference in its entirety. Other elements which may be incorporated into the basement waterproofing system may include a sump 240 for groundwater collection, and a pump for groundwater extraction.

Figure 2:
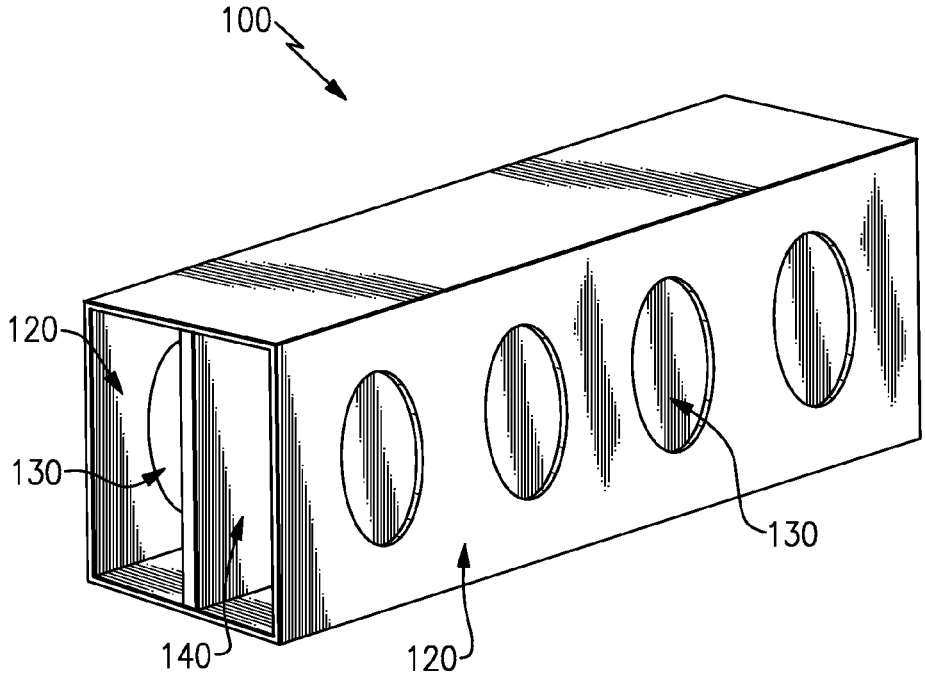
FIG. 2 illustrates a perspective view of a drainage conduit in accordance with one or more embodiments of the present invention.

As illustrated in FIG. 2, one or more embodiments of the conduit 100 of the present invention may generally define a plurality of apertures 130 along both longitudinal sides 120 to allow groundwater to enter the conduit 100. For example, the apertures 130 in a first side 120 may collect backfill saturation from the joint between the foundation wall and footing, while the apertures 130 in a second side 120 may collect groundwater rising from the ground in front of the footing when installed. The conduit may also contain an intermediate structure 140 positioned longitudinally within the conduit 100. The intermediate structure 140 may be solid, as illustrated, or may define apertures along its length. The intermediate structure 140 may add strength to the overall structure of the conduit 100, and may result in a two-channel conduit preventing cross-flow for embodiments that do not include apertures in the intermediate structure 140.

According to other embodiments of the present invention, the conduit may be a multi-component apparatus, the individual parts of which can easily and compactly be brought to a basement for on-site assembly of the conduit. Each component of the conduit may be separately manufactured, such as by an extraction process. Furthermore, each component may be manufactured in a long piece of any desirable length, for example, about one hundred feet, to form a source or supply of each component. In one embodiment, the components are made of a flexible material, such that each source may be rolled or coiled for storage and transport. Beneficially, the components can then be individually cut from the sources to required lengths for assembly of a customized conduit, such as to accommodate the dimensions of a particular basement application. Furthermore, some of the components may be interchangeable for ease of assembly as discussed in greater detail below.

Thus, a modular conduit assembly in accordance with one or more embodiments of the present invention may generally include two side elements which may be mounted between two horizontal elements to create a conduit structure, for example, a substantially rectangular conduit. Each side element may define a plurality of apertures to allow groundwater to enter the conduit. An intermediate element may be incorporated to add support to the conduit structure and, if solid without defining apertures, may create a two-channel system within the conduit to prevent cross-flow.

The various components of the modular drainage conduit may be configured to facilitate assembly in any desired manner. In general, the assembled conduit should maintain its intended shape, be of adequate strength, for example, to support a basement floor applied over it, and should also contain sufficiently sealed joints between components so as to prevent groundwater from escaping after passing into the conduit. In at least one embodiment of the present invention, design features of the individual conduit components may be used to facilitate assembly of the conduit, without requiring an adhesive or mechanical attachment. For example, a mating system, such as one involving male and female mating sections or connectors, may be used to assemble the components.

Structural details of a conduit assembly in accordance with one or more embodiments of the present invention will now be discussed with reference to FIGS. 3 and 3A. A drainage conduit 100 includes two horizontal elements 110 oriented substantially parallel to one another in a spaced apart relationship which may define the height of the conduit 100. Likewise, the width of the horizontal elements 110 may define the overall width of the conduit 100. As illustrated, the horizontal elements 110 are substantially identical in structure, although oriented inverted relative to one another, and therefore may be obtained from a single manufactured horizontal element source.

A first side of each horizontal element 110 may comprise a plurality of mating features 115, configured to correspond to complimentary mating features located on other components in order to facilitate assembly of the modular conduit 100. For example, the mating features 115 may be characterized in certain embodiments as grooves or tracks configured to receive complimentary mating features located on other components. The mating features 115 may be substantially identical to allow interchangeable assembly of components for ease and customization. As illustrated, a mating feature 115 may extend along each longitudinal edge of the first side of horizontal elements 110, and an additional mating feature 115 may extend longitudinally along an intermediate length thereon. In the parallel configuration as illustrated, a mating feature 115 on a first horizontal element 110 may align with a mating feature 115 on a second horizontal element 110 to form a pair of parallel mating features 115 between which another conduit component containing a pair of complimentary mating features can be mounted.

The drainage conduit 100 may also comprise two side elements 120 which may be arranged substantially parallel to one another. The side elements 120 may be spaced apart at a distance about equal to the width of the horizontal elements 110, and oriented substantially perpendicular to the horizontal elements 110, to create a substantially rectangular-shaped conduit. Other conduit shapes are contemplated, however, and the angle at which the side elements 120 are oriented relative to the horizontal elements 110, in addition to the profile of the individual components, will generally define the overall geometry of the conduit 100.

One or both of the side elements 120 may define a plurality of apertures (as shown in FIG. 2) through which groundwater may enter the conduit 100. The apertures may be of any size and shape but should generally be designed and positioned to both promote water entry and prevent clogging. For example, if the apertures are located towards the top of the side elements 120, the groundwater level may not reach the apertures for entry. The apertures may be formed during manufacture of the side elements 120, such as with a molding or punch-out process. Alternatively, it is envisioned that the apertures may be created, for example, on-site during assembly.

Additionally, each side element 120 comprises a pair of complimentary mating features 125, one along each longitudinal edge. The complimentary mating features 125 are configured to correspond to the mating features 115 in order to facilitate conduit assembly. For example, while other configurations are contemplated, the complimentary mating feature 125 may define a tongue to be received by a groove of the mating feature 115. During assembly, a pair of complimentary mating features 125 may be matched, aligned, and joined with a pair of parallel mating features 115 to secure a side element 120 between horizontal elements 110, as illustrated. For example, pairs of parallel mating features 115 may couple or interlock with pairs of complimentary mating features 125 to hold the horizontal elements 110 and the side elements 120 together, such as with a friction fit. Depending on the nature of the mating features, a force may be applied to ensure connection of the conduit elements. Complimentary mating features 125 may comprise additional features, such as ridges or an adhesive, to enhance the friction fit in order to add strength to the joint.

The side elements 120 may generally be structurally identical to one another, as illustrated. Thus, if it is desirable for both of the side elements 120 to define apertures, such that groundwater may enter the conduit 100 from both sides, then both of the side elements 120 may be obtained from a single manufactured side element source. If instead, based on the intended application, it is desirable for only one side element 120 to define apertures, then each side element 120 may be obtained from a separate side element source, one with apertures and one without. A source of side element with apertures may be manufactured simply by adding apertures to a source of side element without apertures. Because all complimentary mating features 125 are configured to correspond to all mating features 115, assembly is interchangeable. For example, a side element 120 containing apertures may be positioned in the conduit assembly 100 as desired, either on a specific side or both sides.

The conduit 100 may also include an intermediate element 140. The intermediate element 140 may be structurally similar to the side elements 120 by also including a pair of complimentary mating features 125, one along each longitudinal edge, compatible with all mating features 115 to facilitate interchangeable assembly. During assembly of the conduit 100, complimentary mating features 125 of the intermediate element 140 may be introduced to the intermediate pair of mating features 115 of the horizontal elements 110, as illustrated. Incorporating the intermediate element 140 may add support to the conduit 100.

The intermediate element 140 may differ structurally from one or more of the side elements 120, if at all, by not defining apertures. If the intermediate element 140 is solid, rather than defining apertures along its length, the intermediate element 140 may also function as a partition to prevent cross-flow within the conduit 100. Without being bound to any particular theory, the apertures on a first side element 120 may intake backfill saturation originating at the joint between the foundation wall and footing, while the apertures on a second side element 120 may intake water originating from the ground in front of the foundation footing. The groundwater entering from each side of the conduit 100 may have different characteristics. For example, groundwater rising from the ground in front of the footing may have a higher concentration of certain undesirable constituents, such as bacteria. Therefore, it may be desirable to isolate the groundwater collected via each of the first and second side elements 120 of the conduit 100. This may be accomplished by incorporating a solid intermediate element 140 without apertures, to prevent migration of the undesirable constituents toward the foundation wall. Furthermore, a solid intermediate element 140 may promote drainage by preventing groundwater entering the conduit 100 through one side from escaping the conduit out the other side. Thus, use of a solid intermediate element 140 may create a two-channel conduit, beneficial for a number of reasons.

During assembly, a solid intermediate element 140 may be obtained from a manufactured intermediate element source. Alternatively, if one of the side elements 120 does not contain apertures, then the same material can be used for the intermediate element 140 because the structures are otherwise identical as discussed above. Likewise, if it is desirable for the intermediate element 140 to define apertures, such as to only provide extra support to the conduit 100, then a side element 120 source material containing apertures can also be used for intermediate element 140 because, again, the structures are otherwise identical. Thus, assembly of the conduit is simple and flexible because many of the pieces may be interchangeable.

In order to assemble the conduit, a desired length of horizontal element may be provided and positioned with mating features facing upward, to create a conduit base. The horizontal element may, for example, comprise three mating features, one along each longitudinal edge, and one intermediate, such as oriented substantially along the center. A desired length of side element may then be provided, for example, to match the length of the horizontal element. A first complimentary mating feature of the side element may be joined or engaged with a mating feature along the first longitudinal edge of the conduit base to create a first substantially vertical conduit side. This step may be repeated to create a second substantially vertical conduit side along the second longitudinal edge of the conduit base. A desired length of intermediate element may also be provided, and a first complimentary mating feature of the intermediate element may be joined with the intermediate mating feature of the conduit base. Finally, another piece of horizontal element may be provided and oriented inverted relative to the conduit base such that its mating features point downward. The mating features of this second horizontal element may be aligned and joined with second complimentary mating features of the side and intermediate elements to create the conduit top, thus completing the assembly.

As should be apparent, assembly of the conduit may be flexible in that many pieces can be assembled interchangeably. For example, one manufactured component comprising mating features may be used to form both horizontal elements of the conduit, and another manufactured component comprising complimentary mating features may be used to form both side elements of the conduit. Additionally, the side element source may be used to provide the intermediate element as well, depending on whether or not apertures in the intermediate element are desired, as discussed above. Furthermore, each component is generally symmetric in nature such that the orientation of individual components is not of concern so long as corresponding mating features align. Customization is enabled, and waste prevented, by the fact that the conduit components may each be cut from sources to specific lengths in order to meet the specifications of particular installation applications. On-site assembly is further facilitated by the fact that a source of each element, for example a side element material and a horizontal element material, may be separately manufactured and compactly stored for convenient transfer to a construction site.

During an installation as discussed above, a desired length of a component may not be available from a single source, such as from a finite roll of side element. This situation may or may not arise, depending on available materials and site-specific factors including the dimensions of the basement application. The problem may be addressed by simply abutting roll ends or otherwise creating a joint between sources. For example, two pieces of side element can be used to match the length of one piece of horizontal element. While a tape or adhesive may be used to fasten the adjoined ends, this is not necessary to ensure the structural integrity of a resulting conduit, particularly when mating systems as described herein are used to assemble conduit components. It may be desirable to stagger seams for strength, such as by placing a seam between pieces of side element in one location along a basement perimeter, and a seam between pieces of horizontal element in another location along the basement perimeter.

Figure 3:
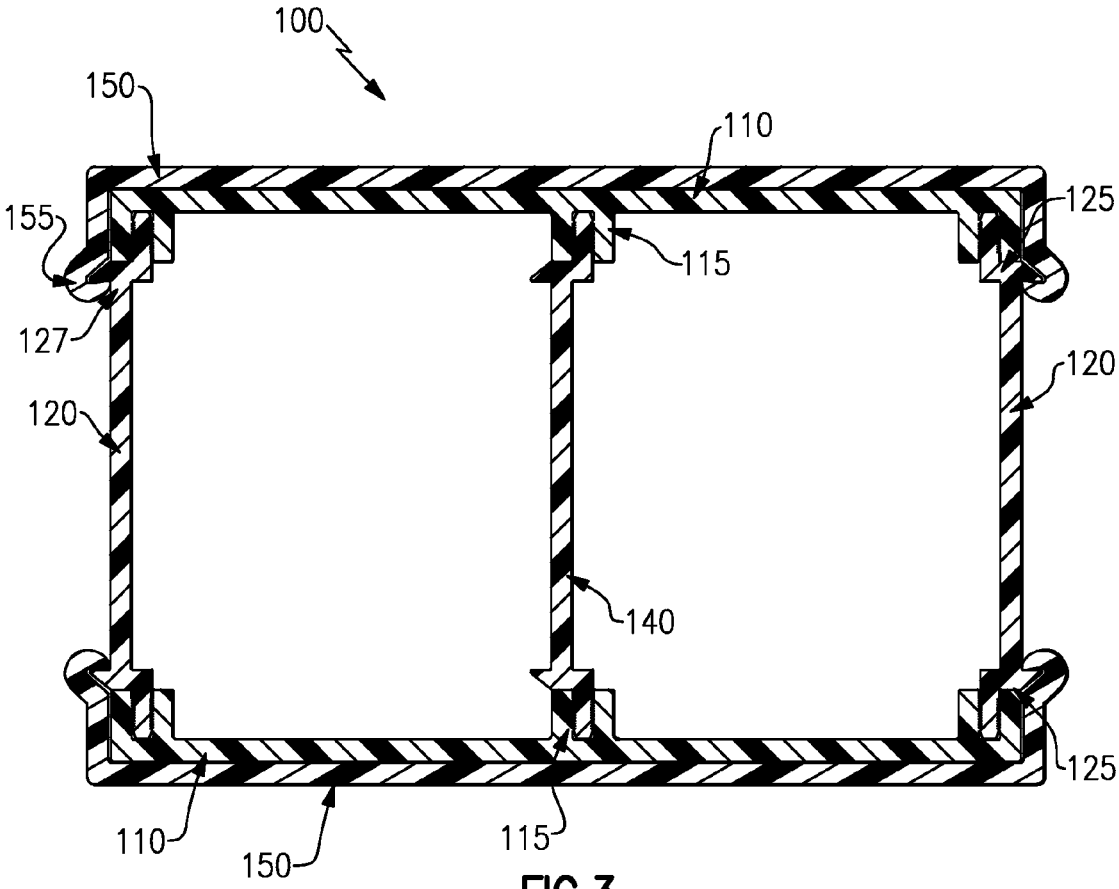
FIG. 3 illustrates a cross-sectional view of a drainage conduit assembly in accordance with one or more embodiments of the present invention.
Figure 3A:
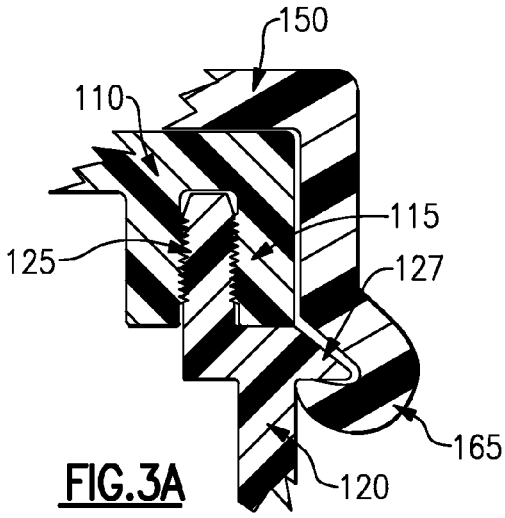
FIG. 3A illustrates a detailed view of a corner of the drainage conduit assembly of FIG. 3.

In some embodiments, as illustrated in FIG. 3, a connector element 150 may be used to further secure seams between, for example, pieces of horizontal element 110. Side elements 120 may include a connector feature 127 configured to join to a complimentary connector feature 155 on connector element 150, such as with a clamping or snapping action. Connector elements 150 may be applied along one or both horizontal elements 110 to enclose a seam between pieces of horizontal element 110. In position, connector element 150 may extend, for example, 5 to 10 inches along a length of conduit 100 to provide extra strength to such a seam.

Figure 4:
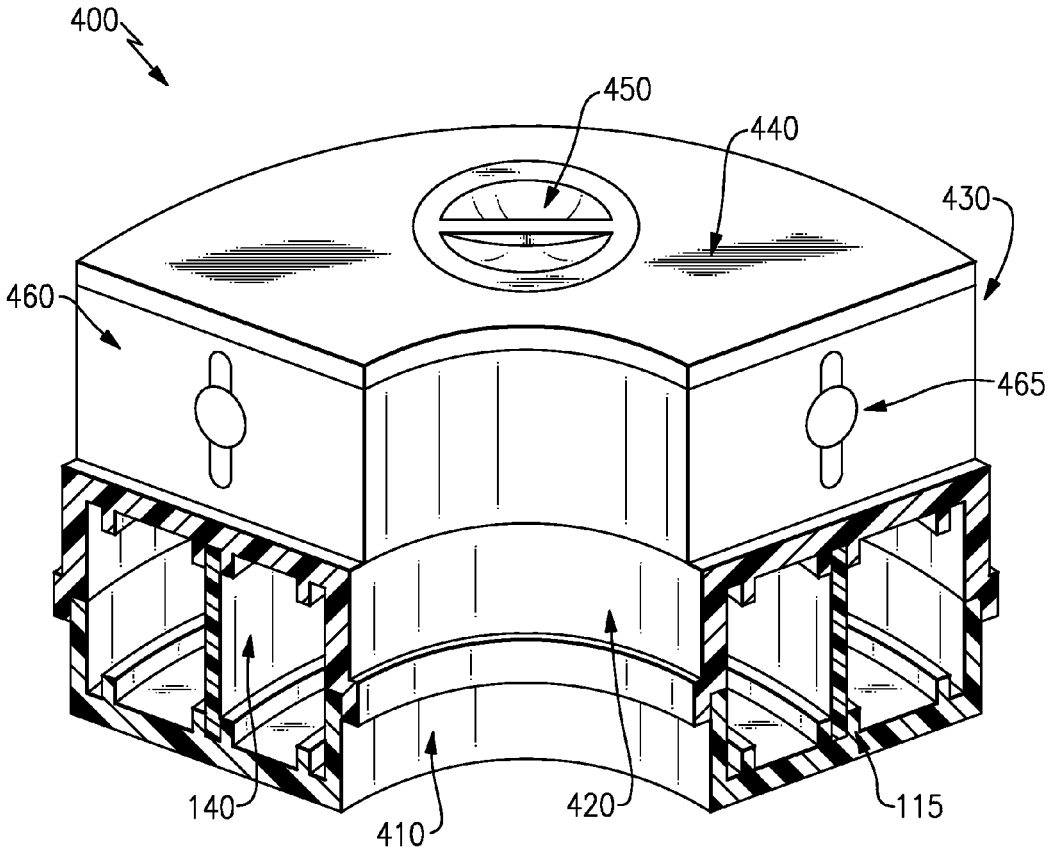
FIG. 4 illustrates a radius element which may be used in conjunction with the conduit of FIG. 2 along a basement perimeter in accordance with one or more embodiments of the present invention.

While the side and intermediate elements of the conduit may be bent to accommodate corners and other obtrusions along a basement perimeter, for example, due to their substantially upright orientation, the horizontal elements may not be capable of conforming to certain geometries even if flexible in nature. Therefore, it is contemplated that special structures, such as a radius element 400 illustrated in FIG. 4, may be provided in basement corners to provide continuity between perpendicular horizontal elements. The radius element 400 may contain a base 410 and a top 420, each comprising parallel mating features 115 which are structurally and spatially consistent with those of the horizontal elements discussed above and, therefore, are compatible with the complimentary mating features of the side and intermediate elements. More specifically, the radius element 400 may be configured such that side and intermediate elements of the conduit may be run through radius element 400 between pairs of perpendicular horizontal elements to create a continuous conduit around a basement corner. For example, FIG. 4 illustrates an intermediate element 140 threaded through the radius element 400. Thus, it is possible that the only resulting joints may be those where horizontal elements are abutted with radius element 400. Other sizes, shapes, and configurations of structures compatible with the disclosed drainage conduit to accommodate corners and other obstacles along a basement perimeter are contemplated without deviating from the overall scope of the invention.

During assembly, a base 410 of the radius element 400 may be positioned between two perpendicular horizontal elements at each basement corner to form a continuous conduit base, taking care to align mating features 115 to create, for example, continuous concentric tracks around a basement perimeter. These tracks can then receive complimentary mating features of side and intermediate elements around the basement perimeter. A top 420 may then be positioned between two additional perpendicular horizontal elements at each corner, engaging the mating system as discussed herein to complete a continuous conduit assembly.

Some embodiments of the radius element 400, as illustrated in FIG. 4, may further comprise a port 430 extending from the top 420. Dirt and other undesirable constituents which enter the basement conduit may tend to collect in corners of the conduit assembly. The port 430 may therefore be beneficial, enabling access to the interior of the conduit through the basement floor for easy cleaning. The port 430 may include a detachable cover 440 to provide access to the conduit interior. The height of the port 430 may be adjustable so that the detachable cover 440 may be aligned with the level of the basement floor in each installation. For example, the port 430 may include a sliding element 460 configured to be vertically adjusted and maintained in a desired position by, for example, one or more mechanical attachments 465. The mechanical attachment 465 may include, for example, screws that mate with a threaded internal portion of the sliding element 460. A plug 450 in the detachable cover 440 may be removable to facilitate cleaning, such as by chemical or hot water flushing of the conduit. The radius element 400 may, in some embodiments, be fluidly connected to a sump for groundwater drainage. Thus, the conduit may be pitched towards one or more of the radius elements 400 to facilitate drainage.

Figure 5:
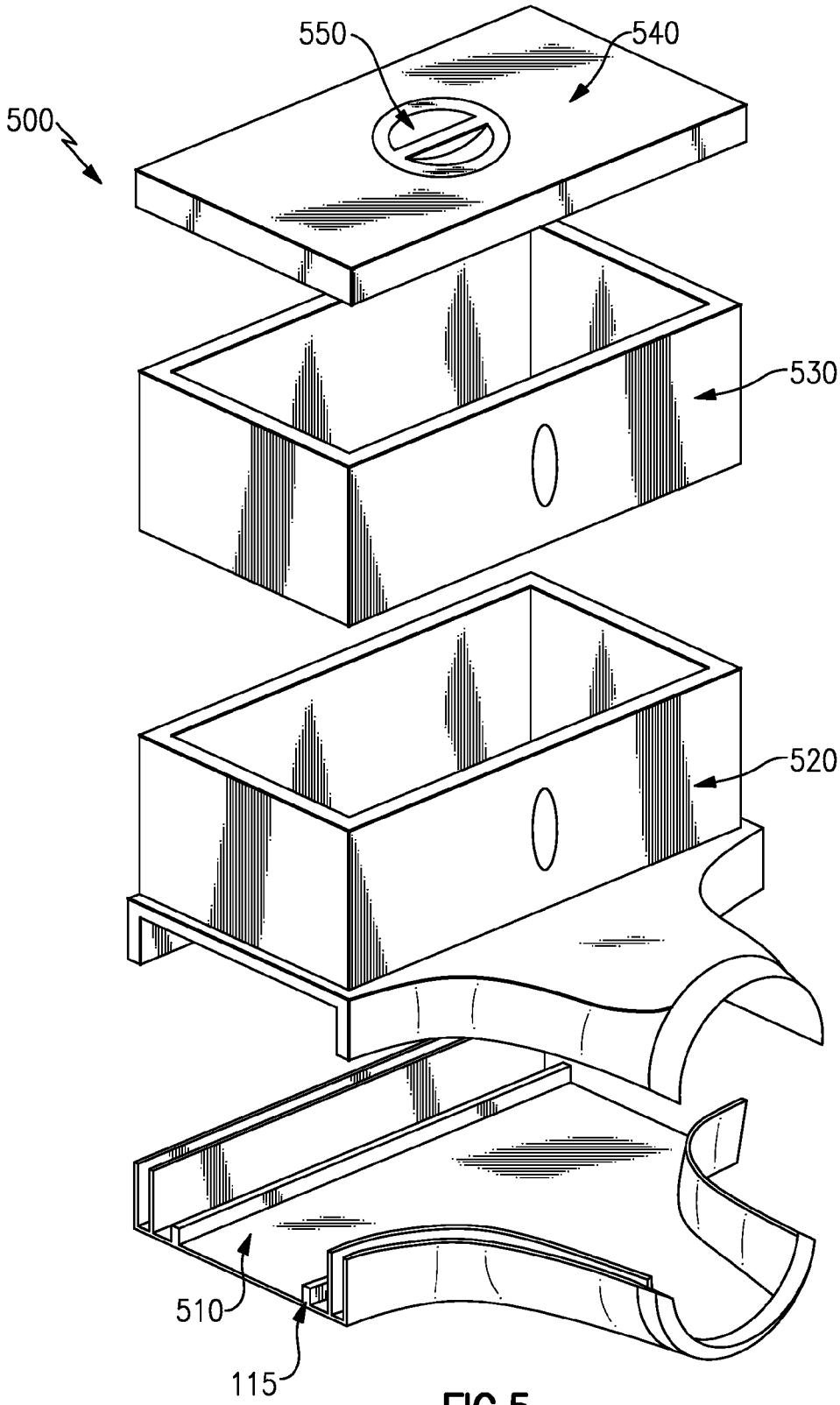
FIG. 5 illustrates components of a conduit port which may be used in conjunction with the conduit of FIG. 2 along a basement perimeter in accordance with one or more embodiments of the present invention.

FIG. 5 illustrates components of another type of access port, a conduit port 500, which may be used in accordance with one or more embodiments of the present invention to also enable access to the conduit interior. The conduit port 500 is similar in structure and assembly to the radius element 400 as illustrated in FIG. 4 discussed above, except that it may be adapted for installation, for example, along a straight portion of a basement drainage conduit, rather than in a corner. As illustrated, the conduit port 500 may include a base 510 and a top 520, both comprising mating features 115 configured and spaced consistent with those of the horizontal elements discussed herein. Thus, it is envisioned that the conduit port 500 may be positioned between pairs of horizontal elements, and that side and intermediate elements of the conduit may be threaded through the conduit port 500 in order to create a continuous conduit assembly.

Some embodiments of the conduit port 500 may further comprise a slider 530 configured to be adjustably received within the top 520. A detachable cover 540 may be configured to connect to the slider 530 to allow access to the conduit interior. The detachable cover 540 may include a removable plug 550 to facilitate cleaning.

The vertical position of the slider 530 relative to the top 520 may be adjusted so as to enable customizable alignment of the detachable cover 540 with a basement floor. The slider 530 may be maintained at a desired vertical position within the top 520 in any manner, such as by friction, or by a mechanical attachment. For example, one or more screws may be used to maintain a desired height of the port 500. In some embodiments, the screws may be inserted from an exterior side of the top 520, an interior side of the slider 530, or both. It should be noted that this slidable adjustment mechanism may also be incorporated into the structure of the radius element 400 in FIG. 4 to facilitate height adjustment of the port 430 relative to a basement floor. Likewise, the slidable adjustment mechanism described herein may be incorporated into the structure of other types of conduit ports and in other conduit systems.

Figure 6:
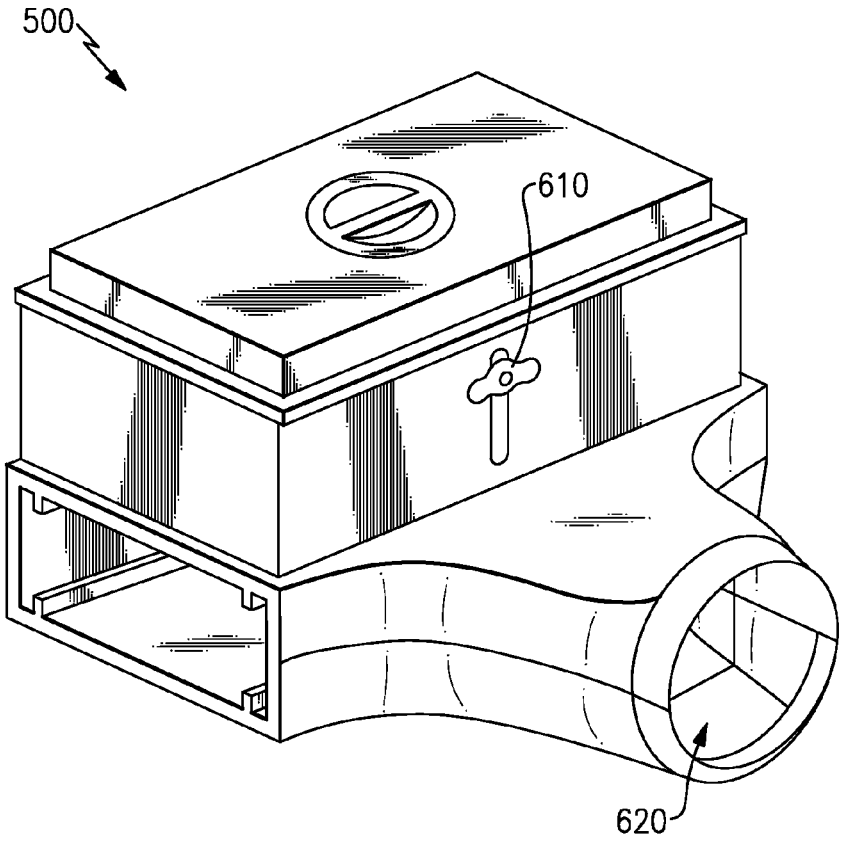
FIG. 6 illustrates the conduit port of FIG. 5 in an assembled configuration.

FIG. 6 demonstrates the conduit port 500 of FIG. 5 in an assembled configuration. As illustrated, a screw mechanism 610 may, for example, be used to adjust the vertical height of the slider. Furthermore, the conduit port 500 may define an outlet 620 as illustrated which may, for example, be fluidly connected to a sump to facilitate groundwater drainage. Ports such as those illustrated in FIGS. 4-6 may be strategically positioned along the basement perimeter. For example, the ports may be installed in locations where it may prove desirable to have access to the conduit interior, such as for cleaning, or to connect to other elements of a basement drainage system.

Each component of the conduit assembly may be separately optimized and constructed of any material suitable for its intended purpose, such as a polyvinyl chloride (PVC) plastic. In some embodiments, each component may be generally flexible in nature. The conduit material should be durable and generally compatible with groundwater, soil, concrete, and any minerals or chemicals with which it may come into contact. The dimensions of the disclosed conduit may vary for different applications but, in general and without limiting the scope of the present disclosure, a typical assembled conduit may be about 2 inches high and about 4 inches wide in cross-section.

It is also contemplated that an antimicrobial agent, commonly known to those skilled in the art, may be incorporated into the conduit material prior to molding or extraction in order to impart antimicrobial properties to the resulting conduit. For example, the antimicrobial compound may be added in an amount of about three to five percent by weight. Without wishing to be bound to any particular theory, a sub-floor drainage conduit having an antimicrobial active surface may be effective in preventing the development of a harmful biofilm thereon.

A conduit kit may be provided for assembly of a conduit in accordance with one or more embodiments of the present invention. For example, the conduit kit may include sources, such as rolls, of horizontal element, side element and intermediate element which may be cut to desired lengths for conduit assembly. Structural features of the components may define a mating system as described herein to facilitate assembly. The kit may also include one or more radius elements and/or conduit ports as discussed above. One or more connector elements may also be provided to impart added strength to any joints in a resulting conduit assembly.

Other embodiments of the conduit of the present invention, and methods for its installation and use, are envisioned beyond those exemplarily described herein.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is

1. A basement drainage conduit, comprising:

a first horizontal element and a second horizontal element;

a first side element and a second side element, each extending between the first horizontal element and the second horizontal element to define a space for conveying groundwater;

an intermediate element extending between the first horizontal element and the second horizontal element along a length of the space; and a conduit port, located along a length of the conduit, constructed and arranged such that a vertical height of the conduit port may be adjusted relative to a basement floor level, wherein the conduit port comprises a base, and a slider configured to be adjustably received by the base, and wherein at least one of the first side element and the second side element defines a plurality of apertures along its length.

2. The conduit of claim 1, wherein the slider comprises a removable lid.

3. The conduit of claim 1, further comprising an outlet fluidly connectable to a sump.

4. The conduit of claim 1, wherein the intermediate element defines a substantially solid surface without apertures along its length.

5. The conduit of claim 1, wherein the first side element and the second side element both define a plurality of apertures.

6. The conduit of claim 1, wherein the conduit is modular.

7. The conduit of claim 1, wherein a first side of the first horizontal element and a first side of the second horizontal element each comprises a plurality of mating features.

8. The conduit of claim 7, wherein the intermediate element, the first side element, and the second side element have longitudinal edges that include a complimentary mating feature configured to mate with the mating features of the first horizontal element and the second horizontal element.

9. The conduit of claim 8, wherein the mating features are engaged with the complimentary mating features.

10. The conduit of claim 1, wherein at least a portion of the conduit is constructed and arranged to accommodate a corner of a basement perimeter.

11. The conduit of claim 1, wherein the conduit defines a two-channel system and wherein the conduit is constructed and arranged to fluidly isolate groundwater collected via the first side element from groundwater collected via the second side element to prevent cross-flow within the two-channel system.

12. A basement drainage conduit, comprising:

a first horizontal element and a second horizontal element;

a first side element and a second side element, each extending between the first horizontal element and the second horizontal element to define a space for conveying groundwater;

an intermediate element extending between the first horizontal element and the second horizontal element along a length of the space; and a conduit port, located along a length of the conduit, constructed and arranged such that a vertical height of the conduit port may be adjusted relative to a basement floor level, wherein at least one of the first side element and the second side element defines a plurality of apertures along its length, and wherein the intermediate element defines a substantially solid surface without apertures along its length.

13. The conduit of claim 12, wherein the conduit port comprises a base, and a slider configured to be adjustably received by the base.

14. The conduit of claim 13, wherein the slider comprises a removable lid.

15. The conduit of claim 12, further comprising an outlet fluidly connectable to a sump.

16. The conduit of claim 12, wherein the first side element and the second side element both define a plurality of apertures.

17. The conduit of claim 12, wherein the conduit is modular.

18. The conduit of claim 12, wherein a first side of the first horizontal element and a first side of the second horizontal element each comprises a plurality of mating features.

19. The conduit of claim 18, wherein the intermediate element, the first side element, and the second side element have longitudinal edges that include a complimentary mating feature configured to mate with the mating features of the first horizontal element and the second horizontal element.

20. The conduit of claim 19, wherein the mating features are engaged with the complimentary mating features.

21. The conduit of claim 12, wherein at least a portion of the conduit is constructed and arranged to accommodate a corner of a basement perimeter.

22. The conduit of claim 12, wherein the conduit defines a two-channel system and wherein the conduit is constructed and arranged to fluidly isolate groundwater collected via the first side element from groundwater collected via the second side element to prevent cross-flow within the two-channel system.

* * * * *